US008844849B2

(12) United States Patent
Schiffer et al.

(10) Patent No.: US 8,844,849 B2
(45) Date of Patent: Sep. 30, 2014

(54) COMMINUTOR FOR MATERIAL

(75) Inventors: Peter Schiffer, Millstatt (AT); Mario Fritz, Millstatt (AT); Egon Tiefnig, Sachsenburg (AT)

(73) Assignee: Manuel Lindner, Spittal/Drau (AT)

( * ) Notice: Subject to any disclaimer, the term of this patent is extended or adjusted under 35 U.S.C. 154(b) by 1004 days.

(21) Appl. No.: 12/743,659

(22) PCT Filed: Nov. 17, 2008

(86) PCT No.: PCT/EP2008/009717

§ 371 (c)(1),
(2), (4) Date: May 27, 2011

(87) PCT Pub. No.: WO2009/068202

PCT Pub. Date: Jun. 4, 2009

(65) Prior Publication Data

US 2011/0259985 A1 Oct. 27, 2011

(30) Foreign Application Priority Data

Nov. 30, 2007 (EP) ..... 07023275

(51) Int. Cl.

| | |
|---|---|
| ***B02C 21/00*** | (2006.01) |
| ***B02C 13/00*** | (2006.01) |
| ***B02C 13/284*** | (2006.01) |
| *B02C 23/16* | (2006.01) |

(52) U.S. Cl.

CPC ..... *B02C 13/284* (2013.01); *B02C 2023/165* (2013.01)

USPC ..... 241/73; 241/242

(58) Field of Classification Search

USPC ..... 241/73, 242, 243

See application file for complete search history.

(56) References Cited

U.S. PATENT DOCUMENTS

| | | | | |
|---|---|---|---|---|
| 4,000,860 | A * | 1/1977 | Gotham | 241/242 |
| 4,385,732 | A * | 5/1983 | Williams | 241/236 |
| 4,557,421 | A | 12/1985 | Probst et al. | |
| 5,150,844 | A | 9/1992 | McKie | |
| 5,213,273 | A * | 5/1993 | Linnerz | 241/73 |
| 5,474,239 | A * | 12/1995 | Williams et al. | 241/73 |
| 7,021,576 | B2 * | 4/2006 | Poeltinger | 241/73 |
| 7,766,263 | B2 * | 8/2010 | Karlsson et al. | 241/73 |
| 7,988,080 | B2 * | 8/2011 | Benes et al. | 241/73 |
| 8,033,487 | B2 * | 10/2011 | Yamashita et al. | 241/73 |
| 2008/0283644 | A1 | 11/2008 | Gassmann et al. | |

FOREIGN PATENT DOCUMENTS

| | | | |
|---|---|---|---|
| EP | 0080621 | A | 6/1983 |
| WO | 2007062700 | A | 6/2007 |

* cited by examiner

*Primary Examiner* — Faye Francis
(74) *Attorney, Agent, or Firm* — IP Strategies

(57) ABSTRACT

A device for comminuting material components includes a housing, at least one rotor that is supported in the housing and has rotor blades and rotor teeth mounted thereon, at least one stator blade that can be supported on the housing, and at least one screen device, which can be moved from an operational state of the comminuting device downward or laterally relative to the housing to a maintenance state, wherein in the operational state the at least one stator blade and the at least one screen device are supported against each other and can be moved together into the maintenance state.

13 Claims, 5 Drawing Sheets

COMMINUTOR FOR MATERIAL

CROSS-REFERENCE TO RELATED APPLICATIONS

Figure 1A:
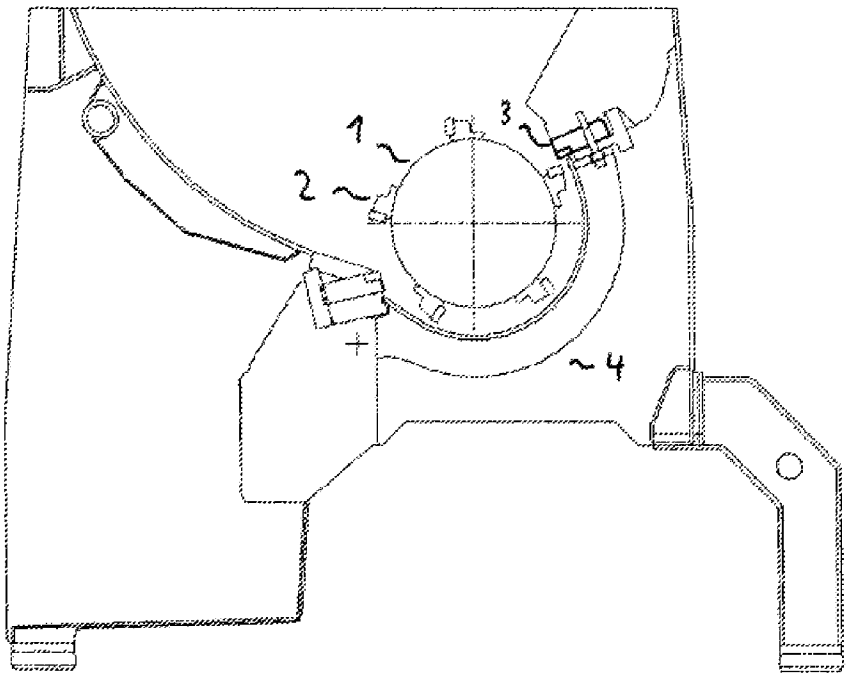

This is a national stage filing of International Application No. PCT/EP2008/009717, which was filed on Nov. 17, 2008, which in turn claims priority from European Patent Application No. 07023275.6, which was filed on Nov. 30, 2007.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

The present invention relates to a device for comminuting the components of a stream of materials and in particular waste products, wherein the device comprises rotating blades and stationary blades (bed blades, stator blades) between which the comminution is accomplished, and a screen device through which the comminuted components are discharged.

2. Description of Related Art Including Information Disclosed Under 37 CFR 1.97 and 1.98

Commercial waste, industrial waste, domestic waste etc., e.g. (hard) plastics, textiles, composites, rubber or scrap wood (such as pallets and particle boards) must be comminuted before they are definitively disposed of or in particular before they are returned to the cycle of valuable substances. For the comminution, single- or dual-shaft comminutors are known in prior art, which are charged, for example, by wheeled loaders, fork lifts or belt conveyors via a hopper for feeding material.

A central element of a conventional comminutor is a rotor unit which comprises a rotor equipped with blades which can be provided e.g. with concavely ground circular cutting crowns. The blades are fastened to blade holders, for example by screwing, which are welded into blade recesses or can be screwed, for example, the recesses being milled into the rotor. The comminution of the fed material is accomplished between the blades rotating together with the rotor and stationary, i.e. non-rotating, bed blades (stator blades, wiper elements).

The fed material can be pressed towards the rotating rotor by a load-controlled pushing device. After the material has been comminuted between the rotating blades and the bed blades, it is discharged through a screen device which determines the factor of comminution according to the mesh size and conveyed further by means of a conveying belt, a spiral conveyor, a chain conveyor or an exhaust system. The screen device can comprise a screen basket with several screen segments, for example with a mesh size of 5 to 150 mm.

The rotating blades as well as the stator blades are subject to extreme wear and therefore have to be turned or replaced after a certain operating time. Equally, the screens must be replaced at regular intervals. In general, the blades mounted on the rotor can be relatively easily turned with just a few adjustments (up to eight times) until they have to be replaced. A typical operating period for the stator blades is 50 to 500 hours. In prior art, two variants of attaching the stator blades with the corresponding maintenance methods involved are well-known.

On the one hand, the stator blades can be fastened together with the screens to a swing-out wall that can be swung upwards. The stator blades are turned or replaced in the swung-out state of the swing-out wall and thus in overhead work, as the swing-out wall must be swung out at overhead height. The overhead work at the heavy stator blades and fastening parts with individual weights of up to 25 kg is troublesome and dangerous and involves relatively long set-up times during which the comminutor cannot be operated. Moreover, the machine rigidity is reduced as the seat of the stator blades cannot be welded to the housing in this variant.

According to an alternative construction, however, the seat of the stator blades is firmly fixed to the machine housing. However, for the maintenance of the stator blades, a mechanic must either descend to the cutting space via the rotor and work at the stator blades in constricted space conditions, which involves a lot of time, or he must perform the required maintenance tasks again overhead after having opened an opening for maintenance in the housing wall.

As the downtime of the comminutor should be minimized for economic reasons, it is desirable to develop a mounting structure for the stator blades which permits a faster and safer maintenance, in particular a facilitated disassembly of worn-out stator blades and the assembly of new stator blades.

BRIEF SUMMARY OF THE INVENTION

The above object is achieved by a comminuting device for comminuting material components fed to the same according to claim 1, comprising a housing;

at least one rotor that is supported in the housing and has rotor blades or rotor teeth mounted thereon;

at least one stator blade that can be supported on the housing; and at least one device that can be moved separately from an operational state of the comminuting device downward or laterally relative to the housing to a maintenance state, characterized in that in the operational state the at least one stator blade and the at least one device are supported against each other and can be moved together from this state to the maintenance state.

The blades can be fastened to the rotor so as to be exchangeable, in particular by screws. Teeth that can be in particular welded to the rotor serve a rather tearing than cutting comminution of the material components.

The device that can be separately moved from the operational state of the comminuting device downward or laterally relative to the housing to a maintenance state can be in particular a screen device. It can also be separate from such a screen device and only be used for moving the stator blade to the maintenance state. In the further description of the invention, a screen device is assumed as the mentioned device by way of example. However, the invention is not restricted thereto.

In particular, the screen device can be swinging from the operational state to the maintenance state. In this case, one end of the screen device which is connected to the comminuting device in operation is suspended in the air in the maintenance state, while the opposite end is linked to the comminuting device (in particular a housing of the same), such that the screen device can swing e.g. about an axle at the linked end and is swung about this axle about a predetermined angle in the maintenance state.

In the operational state, the at least one stator blade and the screen device are connected to each other, namely at the end of the screen device that is suspended in the air in the maintenance state. Provisions can be made for the at least one stator blade to be only connected to the housing of the comminuting device in a further maintenance state that is different to the one mentioned above.

This permits in particular two possibilities for an improved maintenance operation: First, the at least one stator blade can be connected to the at least one screen device in the first maintenance state. Second, the at least one stator blade can be connected to a housing of the comminuting device in the second maintenance state. The comminuting device of the invention can be embodied such that both variants can be selected by a serviceman.

In the comminuting device according to the invention, the at least one stator blade can thus be optionally connected to the housing of the comminuting device in the maintenance state of the screen device.

For example, the at least one stator blade is connected to the at least one screen device as well as to a housing of the comminuting device in the operational state, such that it is connected either only with the at least one screen device or only with the housing of the comminuting device in the maintenance state in accordance with a serviceman's selection (e.g. by releasing corresponding fastening means, such as screws etc.). The connection to the housing or the screen device, respectively, can in particular be accomplished via blade seats which are inserted in corresponding blade recesses.

This means that, if maintenance of the at least one stator blade is required, e.g. the at least one stator blade must be replaced, the screen device is connected to the stator blade in the maintenance state, i.e. it is swung away from the housing of the comminuting device together with the same. In particular, the at least one stator blade can be thereby swung up to a height a mechanic can easily access without having to work overhead, that means up to a height of approximately one meter above the floor space on which the comminuting device is erected. This clearly facilitates the maintenance of the stator blades with respect to prior art, and thus the downtime of the comminuting device is clearly reduced.

If on the other hand only maintenance of a screen of the screen device is required, it is more practicable to swing the same away from the comminuting device and to the maintenance state without changing the position of the at least one stator blade with respect to that in the operational state in the process (i.e. the stator blade is not swung along).

It should be pointed out that according to the present invention, the screen device is used as a transport means for the stator blade to the maintenance state. Though it is intended to swing the screen device according to a preferred further development, the invention can also be realized by a horizontal movement of the screen device out of the operational state or by vertically lowering the same. In these cases, the screen device can support in particular the stator blade released from the housing of the comminutor (or of the blade seat fastened to the same), without the same having to be connected to the screen device by fastening means, or such fastening means only have to be designed to prevent slipping of the stator blade during the movement from the operational state to the maintenance state.

In the comminuting device, the at least one stator blade can be releasably fastened in a stator blade seat which is attached in or at the at least one screen device, in particular by welding or screwing, or which is attached in or at the housing of the comminuting device, in particular by welding or screwing. That means, the actual mechanical support of the stator blade or blades can thus be principally accomplished by the housing of the comminuting device as well as by a frame or the like of the screen device. In the first case, the rigidity of the comminuting device can be increased. In the second case, a possibly required repair of the blade seat can also be facilitated.

In particular, in the comminuting device, the at least one stator blade can be, according to a further development, releasably connected to the housing and/or the at least one screen device by means of connection means which are designed to be operated manually or electrically by a serviceman for fastening the at least one stator blade to the housing and/or the at least one screen device, or for releasing the at least one stator blade from the housing and/or from the at least one screen device.

These connection means can comprise the above mentioned seats for stator blades. They can also include threaded joints, plug-in connections, etc. In particular, they can include connections electrically actuated by corresponding servomotors. Thus, the maintenance comfort can be further increased.

According to an advantageous further development, the screen device of the comminuting device is designed to swing (or to be swung) from the operational state to the maintenance state about an angle of between 10° and 180°, in particular 40° to 60°, in a direction opposite or equal to the sense of rotation of the at least one rotor in the operational state. Here, the angle is dimensioned according to the rotation about an axle at a linked end of the screen device or according to an angular distance of an end of the screen device from the position in which this end is connected, in the operational state, to the stator blade that is connected in this state with the comminuting device (also see the description below with reference to FIG. 1). By swinging about an angle of e.g. 40 to 100 degrees, one can achieve that a serviceman can easily maintain the screens as well as the at least one stator blade.

According to one example, the comminuting device might moreover comprise a hydraulic drive device which is designed to swing the at least one screen device from the operational state of the comminuting device to the maintenance state. Such a hydraulic drive means can work very reliably and inexpensively.

While various designs and types of construction of the screen device are comprised in the present invention, the screen device of the comminuting device can, according to one of the above further developments, at least partially surround the at least one rotor in the operational state. Thus, an efficient, secure material discharge through the screens with classification is achieved. In this case, the at least one screen device exposes at least a portion of at least one rotor in the maintenance state, so that a serviceman has free access to at least one rotor blade or rotor tooth attached to the at least one rotor in the maintenance state. Thus, the rotor blades can also be easily maintained. In particular, the at least one screen device can have the geometric shape of a segment of an ellipsoid. That means, it can have, for example, the shape of a portion of a cylinder or a cylindrical shell or a sphere or a spherical shell.

In the above-described examples of the comminuting device according to the invention, the at least one stator blade and the at least one screen device can advantageously be fastened to each other by a safety screw. Thereby, shifting of the stator blade with respect to the screen device during the movement from the operational state to the maintenance state can be prevented.

Furthermore, the present invention provides a screen device for a comminuting device comprising at least one stator blade, in particular a screen device for one of the above-described further developments of the inventive comminuting device, wherein the screen device comprises connection means which are designed to connect the screen device with one or several stator blades of the comminuting device. Such a screen device can be exchanged as a whole and also be used for expanding existing comminutors, in particular if it is desired that the at least one stator blade is supported in a seat integrated in the screen device.

BRIEF DESCRIPTION OF THE SEVERAL VIEWS OF THE DRAWING(S)

Further features and an exemplary embodiment of the present invention will be illustrated more in detail hereinafter with reference to the drawing. It will be understood that the embodiments do not exhaust the field of the present invention. It will be furthermore understood that some or all features described below can also be combined with each other in a different way.

FIGS. 1*a*, 1*b*, 1*c*, and 1*d* represent one example of a comminuting device according to the present invention in which a stator blade (wiper element) can be brought to a maintenance position to replace the same.

Figure 2:
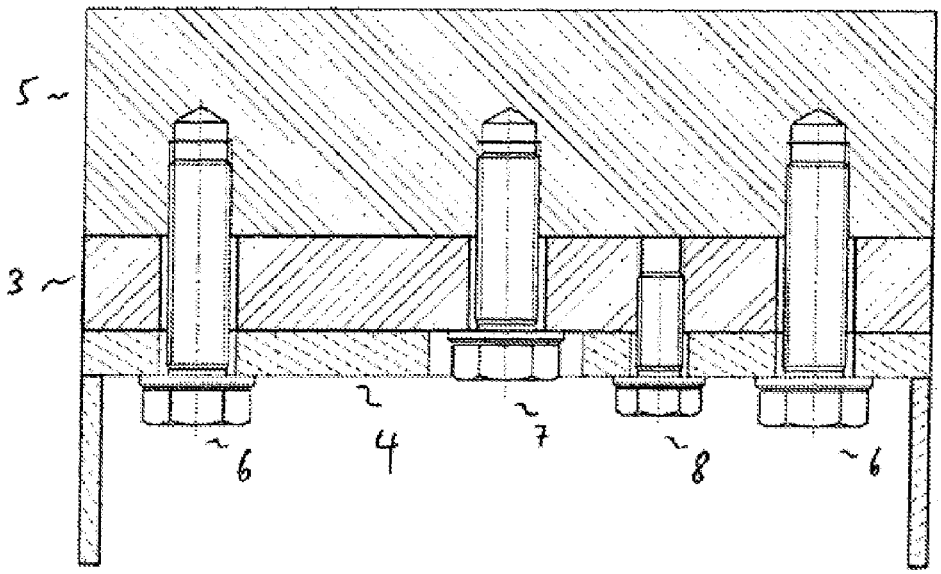

FIG. 2 illustrates an example of a configuration of a screen device, stator blade and housing of the comminuting device according to the present invention.

DETAILED DESCRIPTION OF THE INVENTION

Figure 1B:
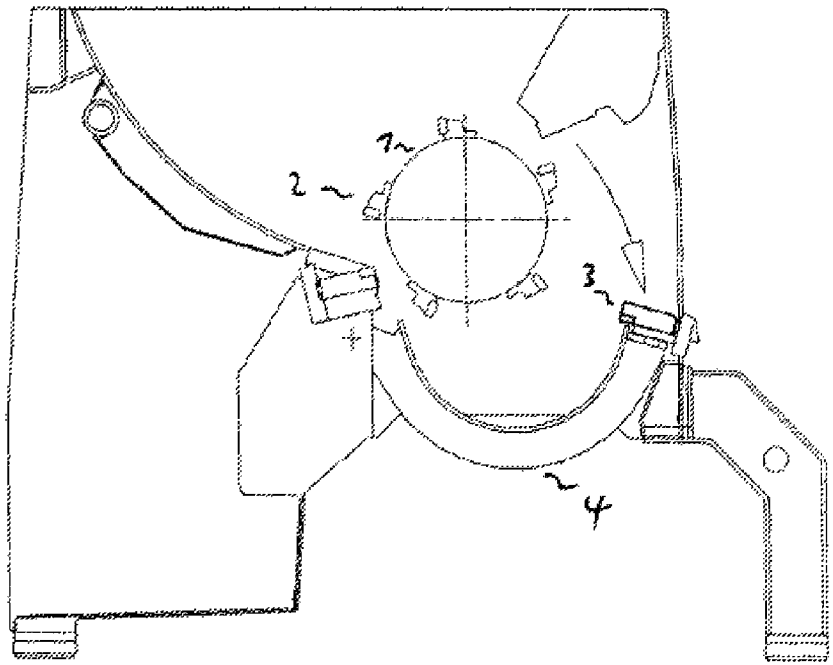
Figure 1C:
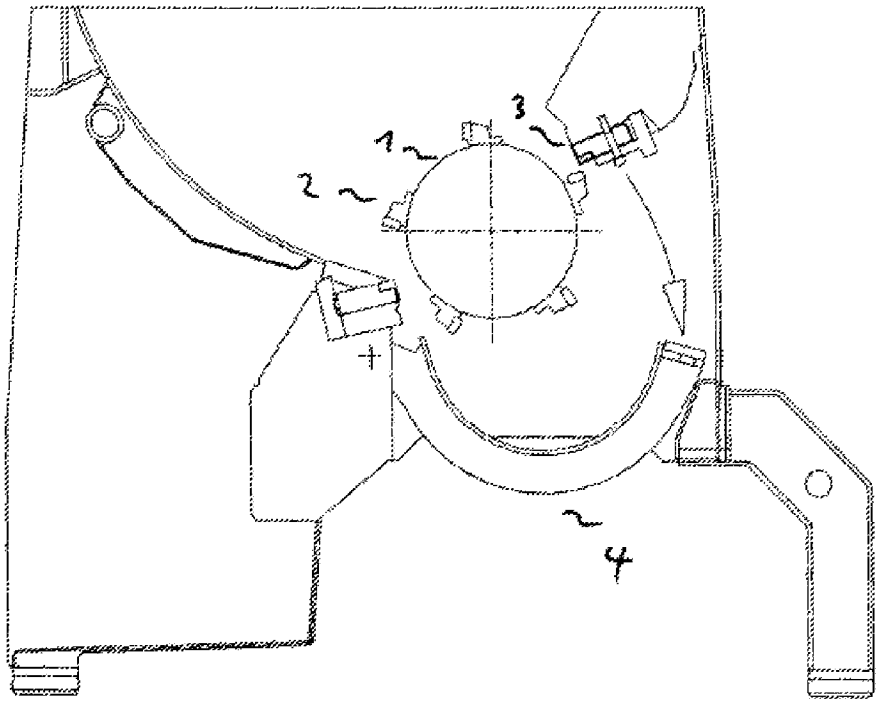
Figure 1D:
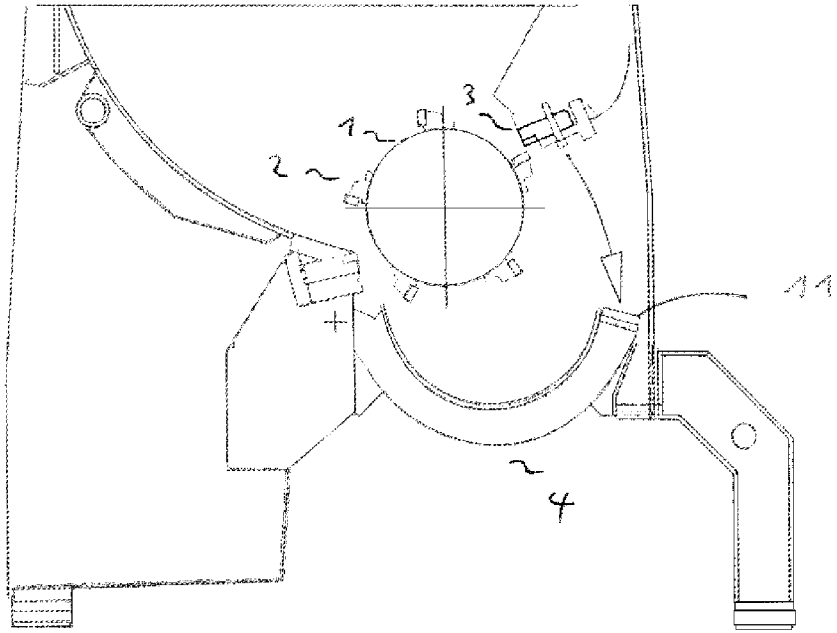

As is shown in FIG. 1*a*, the comminuting device according to the present invention comprises at least one rotor 1 with rotor blades 2 and a stator blade (a wiper element) 3, i.e. a stator blade 3 situated at the top in the figure, also see FIGS. 1*b* and 1*c* Moreover, this comminuting device comprises a screen device 4. The stator blade 3 is connected to the screen device 4 in the operational state. More precisely, connection means are provided between the stator blade 3 and the housing of the comminuting device and between the stator blade 3 and the screen device 4. As shown in FIG. 1*d*, in the comminuting device, the stator blade 3 can be releasably fastened in a stator blade seat 11, which is attached in or at the screen device 4, in particular by welding or screwing, or which is attached in or at the housing of the comminuting device, in particular by welding or screwing.

Optionally, the stator blade 3 can thus remain connected with the screen device 4 by means of connection means when the screen device 4 is swung to the maintenance state, i.e. when the end of the screen device 4 connected to the stator blade 3 in the operational state is swung away from the comminuting device, as is shown in FIG. 1*b*, or it can remain fastened to the housing of the comminuting device, as is shown in FIG. 1*c*.

It can be advantageously provided for the respective connection/fastening of the stator blade 3 to be optionally (by a serviceman's selection) maintained in the maintenance state. In a simplified embodiment, it can also be provided for a support of the stator blade 3 and the screen device 4 against each other to be maintained in any state (maintenance or operational state) without any option by a serviceman. The screen device 4 can be linked at one end to the housing of the comminuting device via an axle or a joint etc., such that a swivel of the screen device 4 about an angle a of 10°, 20°, 30°, or 40°, preferably 50°-120° or more, is effected depending on the exact construction and specific configuration of the comminuting device to permit the maintenance of the stator blade 3 by a serviceman as easy and quick as possible. The person skilled in the art can easily determine and adjust the optimal angle for the simple maintenance. It should be noted that the stator blade can be installed in a device which is movable.

One example of the configuration resulting in the operational state of the screen device, stator blade and housing is shown in the sectional representation in the longitudinal direction (axial direction of the comminuting device) of FIG. 2. The stator blade 3 and screen device 4 are supported against each other. The stator blade 3 is in this example in direct contact with the housing 5. The configuration is secured as follows. A screw 6 is screwed through a boring of the screen device 4 as well as a boring of the stator blade 3 into a thread provided in the housing 5 and in this way secures the mentioned components to each other. Another screw 7 is used for fastening the stator blade 3 to the housing 5 and is correspondingly screwed through a boring of the stator blade 3 into a thread provided in the housing 5.

A serviceman can thus optionally release the screws 6 and 7 to move the screen device 4 together with the stator blade 3 to a maintenance state. As an alternative, he can release the screw 6 without also releasing the screw 7 to move the screen device 4 to another maintenance state without the stator blade 3. In this other maintenance state of the screen device 4, the stator blade 3 remains connected with the housing 5 of the comminuting device.

In FIG. 2, a safety screw 8 is moreover shown which serves to secure the stator blade 3 to the screen device 4 in a movement of the screen device 4 to the first-mentioned maintenance state. This safety screw 8 must also be released by the serviceman if the screen device 4 is to be moved without the stator blade 3 away from the housing 5 to the above mentioned other maintenance state.

In the example shown in FIG. 2, clamping parts can moreover be employed to secure the stator blade 3 to the housing 5 by means of the fastening screw 7 and to secure the stator blade 3 against slipping with respect to the screen device 4 in a movement of the screen device 4 to the first mentioned maintenance state.

It will be understood that the comminuting device according to the invention comprises single—as well as multiple—shaft comminutors and in particular vertical comminutors. Equally, the comminuting device according to the invention comprises single-shaft coarse comminutors which can be preferably employed for coarse-crushing unsorted material.

The invention claimed is:

1. Comminuting device for comminuting material components, comprising a housing;

at least one rotor that is supported in the housing and has rotor blades or rotor teeth mounted thereon;

at least one stator blade configured to be supported on the housing; and at least one screen device configured to be moved separately from an operational state of the comminuting device, downward to a maintenance state by swinging about an axle at a linked end of the screen device such that another end of the screen device that is connected to the comminuting device in the operational state is disconnected from the comminuting device in the maintenance state, wherein in the operational state, the at least one stator blade and the at least one screen device are connected to each other at the other end of the screen device that is connected to the comminuting device in the operational state and is disconnected from the comminuting device in the maintenance state;

and the stator blade and the screen device are configured to be selectively moved together from the operational state to the maintenance state or relative to each other with the stator blade being connected with the housing of the comminuting device in the maintenance state.

2. Comminuting device according to claim 1, wherein in the maintenance state of the screen device, the at least one stator blade is configured to be connected to the housing of the comminuting device.

3. Comminuting device according to claim 1, wherein the at least one screen device is configured to be swung from the operational state of the comminuting device to the maintenance state.

4. Comminuting device according to claim 1, wherein the at least one stator blade is in the operational state connected to the at least one screen device as well as to the housing of the comminuting device.

5. Comminuting device according to claim 1, wherein the at least one stator blade is releasably fastened in a stator blade seat, which is attached in or at the at least one screen device or which is attached in or at the housing of the comminuting device.

6. Comminuting device according to claim 5, wherein the stator blade seat is attached in or at the at least one screen device by welding.

7. Comminuting device according to claim 5, wherein the stator blade seat is attached in or at the housing of the comminuting device by welding.

8. Comminuting device according to claim 1, wherein the at least one stator blade is releasably connected to the housing or the at least one screen device by means of connection means which are designed to be actuated manually or electrically by a serviceman for fastening the at least one stator blade to the housing or the at least one screen device, or for releasing the at least one stator blade from the housing or the at least one screen device.

9. Comminuting device according to claim 1, wherein the at least one screen device can be swung from the operational state to the maintenance state about an angle of between 10° and 180° into a direction opposite or equal to the sense of rotation of the at least one rotor in the operational state.

10. Comminuting device according to claim 1, further comprising a hydraulic drive device which is designed to swing the at least one screen device from the operational state of the comminuting device to the maintenance state.

11. Comminuting device according to claim 1, wherein the at least one screen device at least partially surrounds the at least one rotor in the operational state.

12. Comminuting device according to claim 11, wherein the at least one screen device is configured to expose at least a portion of the at least one rotor in the maintenance state, so that in the maintenance state a serviceman has free access to at least one rotor blade or rotor tooth attached to the at least one rotor.

13. Comminuting device according to claim 1, wherein the at least one stator blade and the at least one screen device are fastened to each other by a safety screw.

* * * * *